United States Patent [19]

Newman et al.

[11] Patent Number: 4,894,144

[45] Date of Patent: Jan. 16, 1990

[54] PREPARATION OF LOWER SULFUR AND HIGHER SULFUR COKES

[75] Inventors: Bruce A. Newman; Bharat S. Chahar, both of Ponca City, Okla.

[73] Assignee: Conoco Inc., Ponca City, Okla.

[21] Appl. No.: 275,295

[22] Filed: Nov. 23, 1988

[51] Int. Cl.[4] ..... C10G 31/06

[52] U.S. Cl. ..... 208/131; 208/50; 208/78; 208/80; 208/89; 423/450; 423/461

[58] Field of Search ..... 208/50, 78, 80, 89, 208/131; 423/450, 461

[56] References Cited

U.S. PATENT DOCUMENTS

| | | | |
|---|---|---|---|
| 2,076,855 | 4/1937 | Mekler | 208/78 |
| 3,472,761 | 10/1969 | Cameron | 208/78 |
| 3,627,671 | 12/1971 | Kozlowski | 208/49 |
| 3,684,688 | 8/1972 | Roselius | 208/50 |
| 3,891,538 | 6/1975 | Walkey | 208/58 |
| 4,075,084 | 2/1978 | Skripek et al. | 208/131 |
| 4,125,455 | 11/1978 | Herbstman | 208/108 |
| 4,351,702 | 9/1982 | Newman et al. | 208/78 |
| 4,446,004 | 5/1984 | Chen et al. | 208/57 |
| 4,501,654 | 2/1985 | Allan | 208/131 |
| 4,518,486 | 5/1983 | Jansma | 208/131 |
| 4,676,886 | 6/1987 | Rahbe et al. | 208/131 |
| 4,795,545 | 1/1989 | Velasco et al. | 208/131 |

*Primary Examiner*—Helane Myers
*Attorney, Agent, or Firm*—C. R. Schupbach

[57] ABSTRACT

A virgin heavy oil is hydrotreated, separated into a light fraction and a heavy fraction which are separately delay coked to obtain (a) a coke product of low sulfur content suitable for use as recarburizer coke or for use in the manufacture of graphite electrodes used in the manufacture of steel and (b) a coke product of higher sulfur content suitable for use in electrodes employed in the manufacture of aluminum.

8 Claims, 1 Drawing Sheet

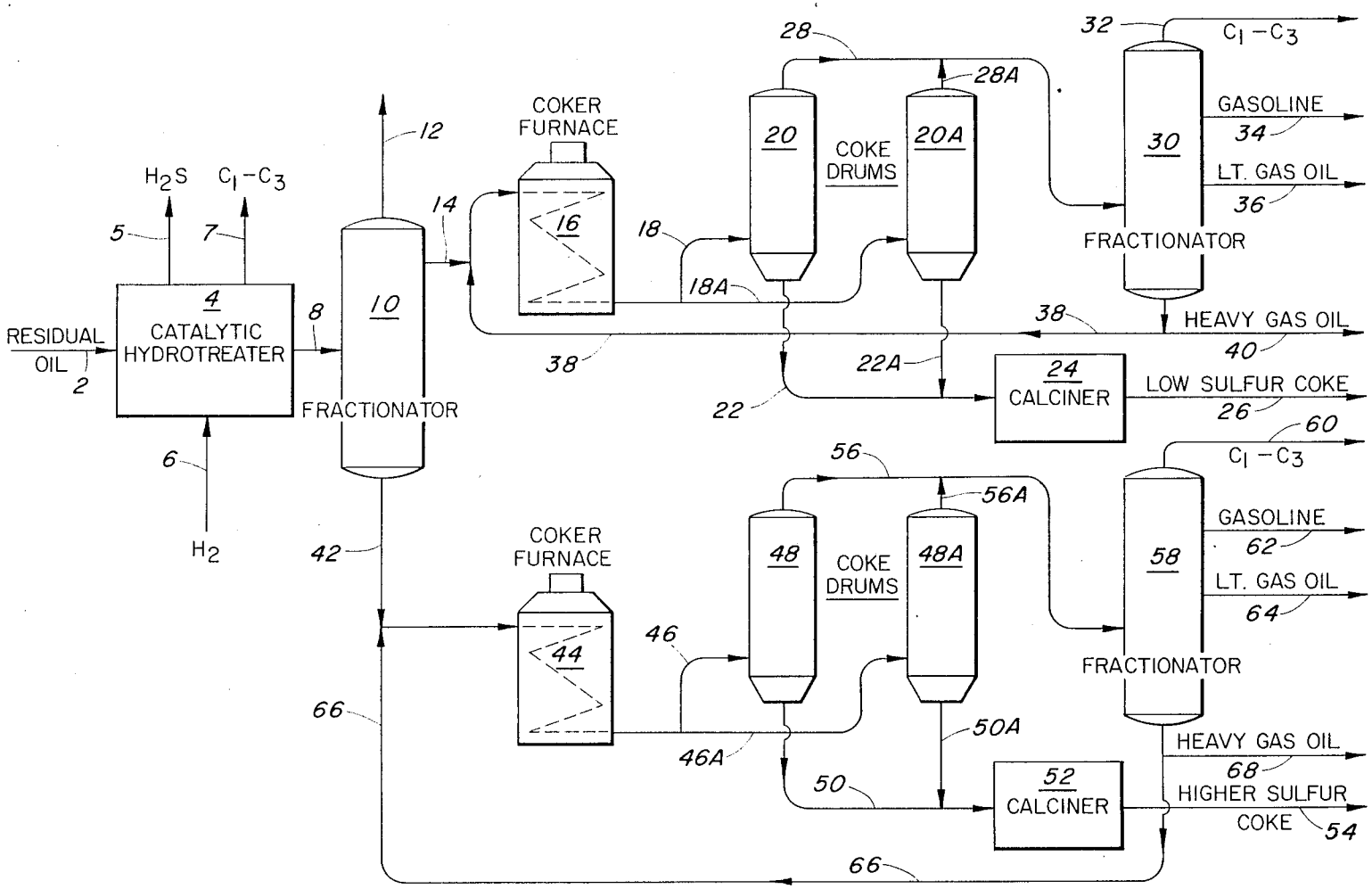
RESIDUAL OIL
2
CATALYTIC HYDROTREATER
4
$H_2S$
$C_1-C_3$
5
7
6
$H_2$
8
FRACTIONATOR
10
12
14
COKER FURNACE
16
18
18A
38
COKE DRUMS
20
20A
28
28A
22
22A
CALCINER
24
FRACTIONATOR
30
32
$C_1-C_3$
GASOLINE
34
LT. GAS OIL
36
HEAVY GAS OIL
40
LOW SULFUR COKE
26
42
COKER FURNACE
44
46
46A
COKE DRUMS
48
48A
56
56A
50
50A
CALCINER
52
FRACTIONATOR
58
60
$C_1-C_3$
GASOLINE
62
LT. GAS OIL
64
HEAVY GAS OIL
68
HIGHER SULFUR COKE
54
66

PREPARATION OF LOWER SULFUR AND HIGHER SULFUR COKES

BACKGROUND AND SUMMARY OF THE INVENTION

Low sulfur recarburizer coke is a type of coke used in the production of high quality steels. Its purpose is to increase the carbon content of the steel without introducing any extraneous contaminants, especially sulfur and nitrogen. Historically, steel producers and recarburizer marketers have used crushed scrap graphite (graphitized premium coke) as the major source of recarburizer coke. However, this source has steadily declined as scrap rates in the graphite electrode production, and electric arc furnaces have been reduced. A market now exists for alternative sources of recarburizer coke with very low levels of sulfur and nitrogen.

Premium coke is a type of coke used for the manufacture of large graphite electrodes for use in electric arc furnaces employed in the steel industry. The quality of premium coke used in graphite electrodes is usually measured by its coefficient of thermal expansion (CTE) which may vary from as low as 0 to as high as 8 centimeters per centimeter per degree centigrade $\times 10^{-7}$. Users of premium coke continuously seek graphite materials having lower CTE values.

Another type of coke which is manufactured in substantial quantities is so called aluminum grade coke, that is, coke which is used in manufacturing electrodes for use in the production of aluminum. This coke contains substantial amounts of sulfur and nitrogen which make it unsuitable for use as recarburizer coke. Also its CTE is substantially higher than that required for premium coke.

Each of the above types of cokes are obtained by subjecting heavy oils, usually petroleum oils, to delayed coking. However, the feedstocks used and the processing conditions used differ for each type of coke, thus they are usually manufactured in separate operations and from separate feedstocks.

In accordance with this invention, a virgin heavy oil is catalytically hydrotreated to substantially reduce its sulfur and nitrogen content; the hydrotreated product is separated into a light fraction and a heavy fraction, each of which is separately subjected to delayed coking; and the delayed coke is calcined to provide two products: a recarburizer or premium grade coke product containing not more than 0.1 weight percent sulfur; and a coke with higher levels of sulfur, which is suitable for use in the manufacture of electrodes used in the production of aluminum. The CTE of the recarburizer coke product is sufficiently low that this material after graphitization is suitable for use as premium coke.

The Prior Art

U.S. Pat. No. 4,446,004 shows a process for upgrading residual oils by hydrotreating the residual oils, fractionating the hydrotreated residual oils and coking the 850° F.+ fraction.

U.S. Pat. No. 3,684,688 discloses hydrotreating residual oil, fractionating the hydrotreated material, subjecting the 1000° F.+ fraction to coking and using the 1000° F. fraction to produce liquid fuel.

U.S. Pat. No. 3,627,671 increases the yield of gasoline and jet fuel by hydrotreating a high boiling feedstock, fractionating the product into two fractions, utilizing the lower boiling fraction for liquid fuels and coking the higher boiling fraction.

U.S. Pat. No. 4,125,455 discloses conversion of sulfur containing oil by admixing the oil with a metal salt, then reacting the mixture with hydrogen to produce a low sulfur lighter oil fraction and a tar fraction containing higher sulfur.

U.S. Pat. No. 3,891,538 discloses hydrodesulfurization of a resid, catalytically cracking the fraction of the desulfurized material boiling from about 650° F. to about 1000° F., combining decant oil from the cracking step with 1000° F.+ material from the desulfurization step and coking same and recycling cycle oil from the cracking step and coker gas oil to the hydrodesulfurization step.

BRIEF DESCRIPTION OF THE DRAWINGS

The drawing is a schematic diagram of a process unit which illustrates the invention.

DETAILED DESCRIPTION OF THE INVENTION

The heavy oils used in the process of the invention comprises virgin oils, which may be crude oils or fractions of crude oils. Preferably, the heavy oils are the residual fractions obtained by the vacuum distillation of crude oils to remove lighter materials. Usually the residual oils which are used are those having an API gravity ranging from about −5 to about 25 and an initial boiling point of about 550° F. to about 1000° F. These oils usually contain from about 0.2 to about 6 weight percent sulfur. They characteristically have an aromatic content of less than about 35 weight percent (based on the percentage of carbon atoms in the aromatic form as measured by carbon −13 NMR).

Referring now to the drawing, residual oil is introduced to catalytic hydrotreater 4 via line 2, with hydrogen being provided to the hydrotreater through line 6.

The catalyst used in hydrotreater 4 comprises a hydrogenation component deposited on a suitable inert carrier. Examples of the various hydrogenation components include the metals, salts, oxides, or sulfides of the metals of periodic groups VIII and VIIIB, for example, chromium, molybdenum, tungsten, iron, cobalt, nickel, ruthenium, rhodium, palladium, osmium, iridium, and platinum. The particular catalyst employed is not critical to the invention and any of the conventional catalysts used for hydrotreating can be used.

These catalysts are typically distended on a suitable inert support of carbon, for example, activated carbon or a dried and calcined gel of an amphoteric metal oxide, for example, alumina, titania, thoria, silica, or mixtures thereof. The most commonly employed carriers are the silica and alumina-containing carriers or mixtures thereof.

The hydrotreating process conditions employed may be summarized as follows:

| | Hydrotreating Conditions | |
|---|---|---|
| | Broad Range | Preferred Range |
| Temperature - °F. | about 500–800 | about 600–750 |
| Pressure - psig | about 800–2600 | about 1000–2200 |
| $H_2$/Oil - SCFB | about 500–6000 | about 1000–5000 |
| LHSV | 0.1–6 | 0.5–2 |

The particular process conditions employed for hydrogenation will depend on the heavy oil feedstock which is used in the process. For purposes of the present invention, the hydrotreating requirements are simply that the overall conditions should be selected to effect sufficient desulfurization of the feed to provide an ultimate recarburizer coke product containing not more than 0.1 weight percent sulfur and preferably not more than 0.05 weight percent sulfur. It is preferred to use hydrotreating conditions which provide a hydrotreated product containing not more than about 0.75 weight percent sulfur and preferably not more than about 0.30 weight percent sulfur.

Referring again to the drawing, the sulfur which is removed from the residual oil feed in the hydrotreating step is taken overhead from the catalytic hydrotreater through line 5. The sulfur is removed from the hydrotreater as hydrogen sulfide. In addition, light gases $C_1$ to $C_3$ are removed from the hydrotreater through line 7. The remaining liquid effluent from the hydrotreater is transferred via line 8 to fractionator 10 where this material is separated into a light fraction and a heavier fraction. The light fraction usually has a maximum boiling point ranging from about 850° F. to about 1150° F. and preferably between about 900° F. and about 1100° F. The entire light fraction may be further processed; however, since low boiling hydrocarbons do not form coke under normal coking conditions, these materials may be removed to provide a light fraction having an initial boiling point ranging from about 550° F. to about 750° F.

The light fraction, which comprises from about 15 to about 85 weight percent of the hydrotreated material entering fractionator 10, is withdrawn from fractionator 10 through line 14 and introduced to coker furnace 16 wherein it is heated to temperatures in the range of about 875° to 975° F. at pressures from about atmospheric to about 250 psig and is then passed via lines 18 and 18A to coke drums 20 and 20A. The coke drums operate on alternate coking and decoking cycles of about 16 to about 100 hours; while one drum is being filled with coke the other is being decoked. During the coking cycle, each drum operates at a temperature between about 850° and about 950° F. and a pressure from about 15 to about 200 psig. The overhead vapor from the coke drums is passed via line 28 or 28A to fractionator 30 while coke is removed from the bottom of coke drums through outlet 22 or 22A. The material entering fractionator 30 is separated into several fractions, a gaseous material which is removed through line 32, a gasoline fraction removed through line 34 and a light gas oil which is removed via line 36. Heavy coker gas oil is taken from the bottom of fractionator 30 and is sent to storage through line 40. If desired, a portion or all of this material may instead be recycled through line 38 to a coker furnace 16.

The green coke which is removed from the coke drums through outlets 22 and 22A is introduced to calciner 24 where it is subjected to elevated temperatures to remove volatile materials and to increase the carbon to hydrogen ratio of the coke. Calcination may be carried out at temperatures in the range of between about 2000° and about 3000° F. and preferably between about 2400° and about 2600° F. The coke is maintained under calcining conditions for between about ½ hour and about 10 hours and preferably between about 1 and about 3 hours. The calcined coke which contains less than 0.1 weight percent sulfur and preferably less than 0.05 percent sulfur is withdrawn from the calciner through outlet 26 and is suitable for use as recarburizer coke.

Since this calcined coke product has a low CTE, varying from about 0 to about $3\times10^{-7}$/°C. (measured between 30° and 98° C. on a ¾" electrode produced from a standard flour formulation), it is also suitable for further processing and use in large graphite electrodes employed in electric arc furnaces for manufacturing steel.

Returning to fractionator 10, if desired (as previously pointed out) low boiling hydrocarbons may be separated from the hydrotreater effluent and removed from the fractionator via line 12. The heavy portion of the hydrotreater effluent, after separation of the light fraction which was removed through line 14, is transferred via line 42 to coker furnace 44 where it is heated, then transferred to coke drums 48 and 48A. Overhead vapors from the coke drums are passed to fractionator 58 and coke is removed from the drums and sent to calciner 52. The operations which are carried out in coker furnace 44, coke drums 48 and 48A, fractionator 58 and calciner 52 and the temperatures, pressures and other process variables employed therein are the same as or similar to those employed in processing the light fraction recovered in fractionator 10.

The calcined coke obtained from calciner 52 contains more than 0.1 weight percent sulfur, usually from about 0.2 to about 1.5 weight percent. Also, the CTE of this product is sufficiently high that it may be less desirable for use in the manufacture of large graphite electrodes used in steel electric arc furnaces than coke produced in drums 20 and 20A. It does, however, have properties which make it useful in the preparation of smaller electrodes for the production of steel and in electrodes for the production of aluminum.

The following examples illustrate the results obtained in carrying out the invention.

EXAMPLE 1

A virgin residual oil was subjected to hydrotreating in a pilot plant in the presence of a nickel-molybdenum on alumina hydrogenation catalyst. Properties and composition of the feed material are shown in Table 1. The hydrotreating conditions and product properties are given in Table 2.

TABLE 1

| RESIDUAL OIL | |
|---|---|
| Sulfur - Weight Percent | 0.79 |
| Nitrogen - Weight Percnet | 0.45 |
| Gravity - API | 13.4 |
| C-13 NMR, Percent Aromatic Carbon Atoms | 25.9 |

TABLE 2

| | |
|---|---|
| Reactor Temperature - °F. | 750 |
| Reactor Pressure - psig | 1500 |
| LHSV - 1/Hr | 0.46 |
| $H_2$/Oil Ratio - SCFB | 3000 |
| Product Properties | |
| API Gravity | 21.1 |
| Sulfur - Weight Percent | 0.15 |
| Nitrogen - Weight Percent | 0.15 |

The hydrotreated product was separated into two fractions, one boiling between 550° and 900° F. and the other boiling above 900° F. Each fraction was subjected to delayed coking for 32 hours at 875° F. and 140 psig.

The results of the fractionation and coking are presented in Table 3.

TABLE 3

| | 500–900° F. Fraction | 900° F.+ Fraction |
|---|---|---|
| Feed | | |
| Weight Percent of the Hydrotreated Vacuum Resid | 18.0 | 76.8 |
| Sulfur - Weight Percent | 0.02 | 0.19 |
| Product Coke | | |
| Yield - Weight Percent | 4.6 | 21.3 |
| CTE*, $10^{-7}$/°C. | 0.43 | 3.91 |
| Sulfur, Weight Percent | 0.014 | 0.47 |

*After calcining at 2400° F. for 3 hours at atm pressure. The CTE measured between 30 and 98° C. on a standard ¾" electrode is estimated from the height of the 002 x-ray peak of calcined coke. It is well known that a strong correlation exists between coke CTE and x-ray properties of calcined coke.

It is noted that the coke obtained from the 550° F.–900° F. fraction has a sulfur content which makes it suitable for use as recarburizer coke. The sulfur content of the 900° F.+ fraction coke is about 34 times as large as the sulfur in the coke from the lower boiling fraction. Also, the 550°–900° F. fraction provides a calcined coke which yields an electrode having a CTE roughly 9 times lower than the electrode obtained from the heavier fraction. The lower CTE coke would be extremely desirable for use in production of large graphite electrodes for the steel industry. This CTE, in fact, is lower than the CTE of coke obtained from any commercial coking processes.

EXAMPLE 2

A sweet virgin resid was hydrotreated in the presence of a nickel molybdenum on alumina catalyst. Hydrotreating conditions, feedstock properties and hydrotreated product properties are shown in Table 4.

| Run Conditions | | |
|---|---|---|
| Reactor Temperature - °F. | 750 | |
| Reactor Pressure - psig | 1500 | |
| LHSV - 1/Hr | 0.90 | |
| $H_2$ to Oil Ratio - SCFB | 3000 | |
| Properties | Resid | Hydrotreated Resid |
| API Gravity | 22.8 | 27.7 |
| Sulfur - Weight Percent | 0.58 | 0.03 |
| Nitrogen - Weight Percent | 0.1 | <0.1 |
| Percent Aromaticity by C-13 NMR | 17.5 | 10.9 |

Two representative samples of the hydrotreated resid were fractionated to provide 900° F.−, 900° F.+, 1000° F.− and 1000° F.+ fractions. Each fraction was coked for 32 hours at 885° F. and 140 psig. The results of the fractionation and coking are given in Table 5.

TABLE 5

| | 900° F.− Fraction | 900° F.+ Fraction | 1000° F.− Fraction | 1000° F.+ Fraction |
|---|---|---|---|---|
| Feed | | | | |
| Weight Percent of the Hydrotreated Resid | 56.6 | 43.4 | 73.3 | 26.7 |
| Sulfur - Weight Percent | 0.004 | 0.07 | 0.004 | 0.114 |
| Product Coke | | | | |
| Yield - Weight Percent | 2.1 | 9.7 | 2.9 | 11.4 |
| CTE* - $10^{-7}$/°C. | 2.1 | 4.6 | 1.6 | 7.4 |
| Sulfur - Weight Percent | <0.01 | 0.26 | <0.01 | 0.41 |

*After calcining at 2400°F. for 3 hours at atm pressure. The CTE was measured in the same manner as in Example 1.

Here again, both sulfur content and CTE of the cokes produced from the 900° F.− and 1000° F. − fractions are significantly lower than values of cokes obtained from the 900° F.+ and 1000° F.+ fractions.

EXAMPLE 3

A decant oil from a FCC unit and a coal tar pitch were subjected to hydrotreating in the presence of a nickel-molybdenum on alumina catalyst. Hydrotreating conditions, feedstock properties and hydrotreated product properties are shown in Table 6.

TABLE 6

| Run Conditions | Decant Oil | Coal Tar Pitch |
|---|---|---|
| Reactor Temperature - °F. | 700 | 725 |
| Reactor Pressure - psig | 800 | 1500 |
| LHSV - 1/Hr | 1.00 | 1.00 |
| Hydrogen to Oil Ratio - SCFB | 3500 | 3000 |

| | DECANT OIL | | COAL TAR PITCH | |
|---|---|---|---|---|
| Properties | Not Hydro-treated | Hydro-treated | Not Hydro-treated | Hydro-treated |
| Gravity - API | — | — | −13.6 | −5.4 |
| Sulfur - Weight Percent | 1.12 | 0.37 | 0.74 | 0.15 |
| Nitrogen - Weight Percent | 0.10 | 0.10 | 1.00 | 0.60 |
| C 13 NMR, Percent Aromatic Carbon Atoms | 63.9 | 51.5 | 93.5 | 74.2 |

The hydrotreated decant oil was separated into two fractions, a 550° F. to 900° F. fraction and a 900° F.+ fraction. The hydrotreated coal tar pitch was also separated into two fractions, a 850° to 950° F. fraction and a 950° F.+ fraction. Each of these fractions was subjected to delayed coking for 32 hours at a temperature of 875° F. and a pressure of 140 psig. The results of the fractionation and coking are shown in Table 7.

TABLE 7

| | DECANT OIL | | COAL TAR PITCH | |
|---|---|---|---|---|
| | 550–900° F. Fraction | 900° F.+ Fraction | 850–950° F. Fraction | 950° F.+ Fraction |
| Feed | | | | |
| Weight Percent of the Hydrotreated Material | 85.4 | 12.8 | 9.2 | 34.0 |
| Sulfur - Weight Percent | 0.36 | 0.42 | 0.21 | 0.17 |
| Product Coke | | | | |
| Yield - Weight Percent | 21.9 | 62.9 | 70.8 | 82.7 |
| CTE* - $10^{-7}$/°C. | 0.83 | 1.05 | 1.46 | 0.83 |
| Sulfur - Weight Percent | 0.41 | 0.42 | 0.18 | 0.16 |

*After calcining at 2400° F. for 3 hours at atm pressure. The CTE was measured in the same manner as in Example 1.

It is noted that both fractions of the decant oil produce coke products having essentially the same sulfur contents, in both cases much greater than 0.10 weight percent. In addition, there is little difference in the CTE values of the calcined cokes. The same observations may be made for the coke products obtained from the hydrotreated coal tar fractions. None of the coke products from these feed materials would be suitable for use as recarburizer coke.

It is also noted that the CTE values of electrodes prepared from calcined cokes obtained from the lower boiling fractions of the virgin residual oils (Examples 1 and 2) are essentially equivalent to those of the cokes produced in this example. These coke sulfur contents in combination with CTE values demonstrate that the process of the invention applies only to virgin oils and not to more typical cracked coker feedstocks, such as decant oils, coal tar pitches, thermal tars, and pyrolysis tars.

While certain embodiments and details have been shown for purposes of illustrating the present invention, it will be apparent to those skilled in the art that various changes and modifications may be made herein without departing from the spirit or scope of the invention.

We claim:

1. A process for producing a lower sulfur coke and higher sulfur coke from a single feedstock which comprises:

(1) catalytically hydrotreating a virgin heavy oil having an API gravity of from about −5 to about 25 and an initial boiling point of from about 550° F. to about 1,000° F. to reduce the sulfur content of the hydrotreated product to not more than about 0.75 weight percent.

(2) separating the hydrotreated product into a heavy fraction and a light fraction, (3) separately subjecting each fraction to delayed coking, (4) calcining the resulting green coke products to obtain (a) from the coked light fraction a low sulfur calcined coke, and (b) from the coked heavy fraction a higher sulfur calcined coke.

2. The process of claim 1 in which the heavy oil is a residual oil.

3. The process of claim 2 in which the light fraction has a maximum boiling point between about 850° F. and about 1150° F.

4. The process of claim 2 in which the light fraction has a maximum boiling point between about 900° F. and about 1000° F.

5. A process for producing a lower sulfur and lower CTE coke and a higher sulfur and higher CTE coke from a single feedstock which comprises:

(1) subjecting a virgin residual oil having an API gravity of from about −5 to about 25 and an initial boiling point of from about 550° F. to about 1,000° F. to catalytic hydrotreating under conditions to provide a hydrotreated product having a sulfur content of not more than about 0.75 weight percent sulfur.

(2) separating the hydrotreated product into two fractions, a light fraction and a heavy fraction, the light fraction having a maximum boiling point between about 850° F. and about 1150° F., and the remaining higher boiling portion of the hydrotreated product comprising the heavy fraction.

(3) separately subjecting each fraction to delayed coking, (4) calcining the resulting green coke products to obtain (a) from the coked light fraction a calcined coke containing less than 0.1 weight percent sulfur and having a CTE of between about 0 and about $3\times10^{-7}$/°C., and (b) from the coked heavy fraction a calcined coke containing more than 0.1 weight percent sulfur and having a CTE above about $3\times10^{-7}$/°C.

6. The process of claim 5 in which the lighter fraction has a maximum boiling point between about 900° and about 1000° F.

7. The process of claim 6 in which the catalytic hydrotreating is carried out at a temperature range of about 500° to 800° F., a pressure of between about 500 and about 2600 psig, a hydrogen to oil ratio of about 500 to about 6000, and a LHSV of about 0.1 to about 6.

8. The process of claim 7 in which the delayed coking is carried out at a temperature between about 850° and about 950° F., a pressure between about 15 to about 200 psig, and a coking cycle between about 16 and about 100 hours.

* * * * *